US007409338B1

(12) United States Patent
Nien

(10) Patent No.: US 7,409,338 B1
(45) Date of Patent: Aug. 5, 2008

(54) SOFTBIT SPEECH DECODER AND RELATED METHOD FOR PERFORMING SPEECH LOSS CONCEALMENT

(75) Inventor: Hsi-Wen Nien, Hsin-Chu County (TW)

(73) Assignee: Mediatek Incorporation, Hsin-Chu Hsien (TW)

( * ) Notice: Subject to any disclaimer, the term of this patent is extended or adjusted under 35 U.S.C. 154(b) by 773 days.

(21) Appl. No.: 10/904,429

(22) Filed: Nov. 10, 2004

(51) Int. Cl.
*G10L 19/00* (2006.01)

(52) U.S. Cl. ..... 704/200; 704/229; 704/500; 704/226; 714/758

(58) Field of Classification Search ..... 704/200, 704/229, 226, 500; 714/758
See application file for complete search history.

(56) References Cited

U.S. PATENT DOCUMENTS

| | | | | |
|---|---|---|---|---|
| 5,502,713 | A | 3/1996 | Lagerqvist | |
| 5,572,622 | A * | 11/1996 | Wigren et al. | 704/228 |
| 6,377,553 | B1 * | 4/2002 | Vary et al. | 370/252 |
| 6,377,755 | B1 | 4/2002 | Vary | |
| 6,714,908 | B1 * | 3/2004 | Naka | 704/228 |
| 6,912,498 | B2 * | 6/2005 | Stevens et al. | 704/235 |
| 6,952,668 | B1 * | 10/2005 | Kapilow | 704/206 |
| 6,968,309 | B1 * | 11/2005 | Makinen et al. | 704/219 |
| 7,110,947 | B2 * | 9/2006 | Cox et al. | 704/236 |
| 2007/0239462 | A1 * | 10/2007 | Makinen et al. | 704/500 |

OTHER PUBLICATIONS

Fingscheidt et al. "speech decoding with error concealment using residual source redundancy"□□□□IEEE 1197 pp. 91-92.*
Tim Fingscheidt, Peter Vary; Softbit Speech Decoding: A New Approach to Error Concealment; IEEE Transactions on Speech and Audio Processing; vol. 9, No. 3, Mar. 2001; p. 240-p. 251.

* cited by examiner

*Primary Examiner*—Daniel D Abebe
(74) *Attorney, Agent, or Firm*—Winston Hsu

(57) ABSTRACT

A softbit speech decoder includes a speech loss concealment circuit receiving bit information, bit error probability data, and a speech information flag from an equivalent channel based on a received signal provided to the equivalent channel. The speech loss concealment circuit also contains a speech data judging circuit for judging whether the speech information flag indicates that the received signal contains speech data, a parameter generating circuit for generating output information, including a speech-parameter error probability vector when the speech information flag indicates that the received signal does not contain speech data. When the received signal does not contain speech data, the speech-parameter error probability vector generated by the parameter generating circuit allows the softbit speech decoder to continue operating.

16 Claims, 5 Drawing Sheets

SOFTBIT SPEECH DECODER AND RELATED METHOD FOR PERFORMING SPEECH LOSS CONCEALMENT

BACKGROUND

The present invention relates to a softbit speech decoder, and more specifically, to a softbit speech decoder capable of executing when the received signal contains no speech data.

In digital speech communication, bit errors in noisy channels cause a reduction in quality. To help eliminate bit errors that still remain, a process called error concealment is performed.

In the article entitled "Softbit Speech Decoding: A New Approach to Error Concealment" by Tim Fingscheidt and Peter Vary, published in the "IEEE Transactions on Speech and Audio Processing", Vol. 9, No. 3, March 2001, the authors describe an error concealment approach using a softbit speech decoder. This article is herein incorporated by reference in its entirety.

Please refer to FIG. 1. FIG. 1 is a functional block diagram of a speech decoding system 10 utilizing a softbit speech decoder 50 according to the related art. In the speech decoding system 10, an equivalent channel 12 provides speech parameters X(t) and bit error probability data P(t) to a parameter transition probability circuit 14 of the softbit speech decoder 50. The parameter transition probability circuit 14 takes this data and thereby calculates speech-parameter error probability data W(t), which is sent to an a posteriori probability circuit 16. The a posteriori probability circuit 16 receives prior knowledge from an a priori knowledge circuit 18 and thereby provides probability information about any possibly transmitted bit combination. All of this data is output from the a posteriori probability circuit 16 to a parameter estimation circuit 20, which generates estimated speech parameters V(t) accordingly.

As long as the equivalent channel 12 is receiving speech data, the equivalent channel 12 provides this speech data to the softbit speech decoder 50, and the softbit speech decoder 50 will operate normally. However, if the equivalent channel 12 receives control signals instead of speech data, the parameter transition probability circuit 14 will not be able to produce the speech-parameter error probability data W(t), and the softbit speech decoder 50 will cease operation. Therefore, the softbit speech decoder 50 will not be able to reduce the subjective effects of bit errors that have not been eliminated by channel decoding when no speech data are transmitted.

SUMMARY OF INVENTION

It is therefore an objective of the claimed invention to provide an improved softbit speech decoder and related method in order to solve the above-mentioned problems.

According to the claimed invention, a softbit speech decoder includes a speech loss concealment circuit. The speech loss concealment circuit receives bit information, bit error probability data, and a speech information flag from an equivalent channel based on a received signal provided to the equivalent channel. The speech loss concealment circuit also contains a speech data judging circuit for judging whether the speech information flag indicates that the received signal contains speech data, a parameter generating circuit for generating output information, including a first speech-parameter error probability vector when the speech information flag indicates that the received signal contains speech data and a second speech-parameter error probability vector when the speech information flag indicates that the received signal does not contain speech data. The softbit speech decoder also contains a probability generating device for providing probability information based on the output information, a parameter estimation circuit for calculating estimated speech parameters based on the probability information, and a speech decoding circuit for decoding speech signals based on the estimated speech parameters output from the parameter estimation circuit.

According to the claimed invention, a method of softbit speech decoding includes receiving bit information, bit error probability data, and a speech information flag from an equivalent channel based on a received signal provided to the equivalent channel, judging whether the speech information flag indicates that the received signal contains speech data, and generating output information, including a first speech-parameter error probability vector when the speech information flag indicates that the received signal contains speech data and a second speech-parameter error probability vector when the speech information flag indicates that the received signal does not contain speech data. The method also includes providing probability information based on the output information to calculate estimated speech parameters, and decoding speech signals based on the estimated speech parameters.

It is an advantage of the claimed invention that the parameter generating circuit generates the second speech-parameter error probability vector when the speech information flag indicates that the received signal does not contain speech data for continuing the operation of the softbit speech decoder when no speech data are received.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
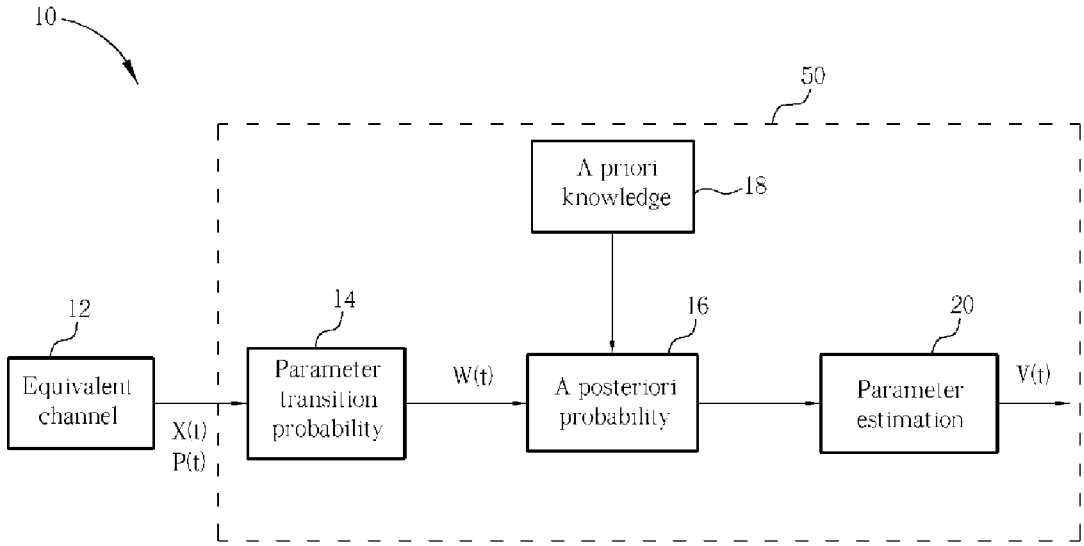
Fig. 1 Related Art
FIG. 1 is a functional block diagram of a speech decoding system utilizing a softbit speech decoder according to the related art.
Figure 2:
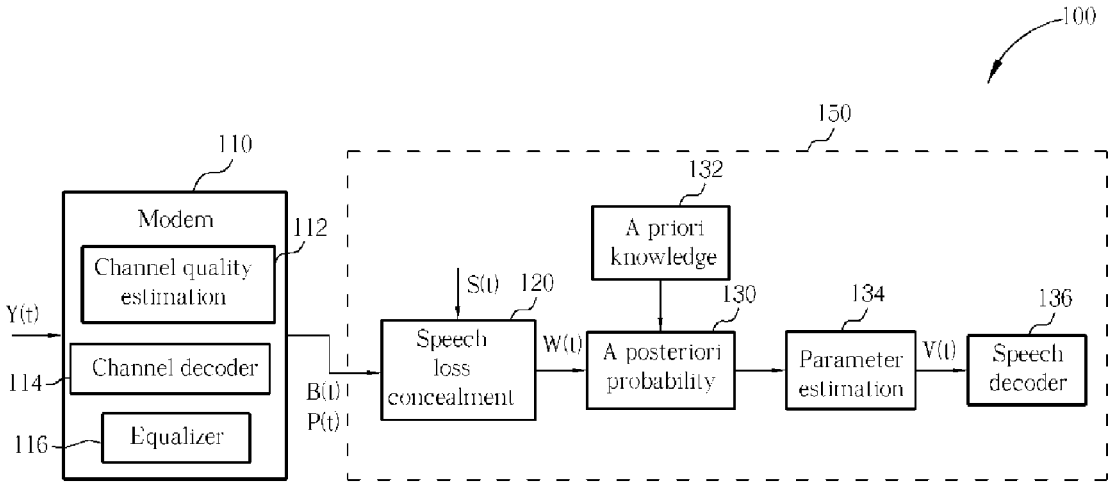
FIG. 2 is a functional block diagram of a speech decoding system utilizing an improved softbit speech decoder according to a first embodiment of the present invention.

Please refer to FIG. 2. FIG. 2 is a functional block diagram of a speech decoding system 100 utilizing an improved softbit speech decoder 150 according to a first embodiment of the present invention. The speech decoding system 100 contains a modem 110, or other channel demodulation device, which receives a received signal Y(t). The received signal Y(t) can be a wireless signal, or any other signal used for transmitting speech data and control signals. Preferably, the modem 110 contains a channel quality estimation circuit 112 for estimating the channel quality of the received signal Y(t), a channel decoder circuit 114 for decoding channel information, and an equalizer circuit 116 for equalizing the channel data. The modem 110 outputs bit information B(t) and bit error probability data P(t) to a speech loss concealment circuit 120 of the softbit speech decoder 150. In addition, a speech information flag S(t) is also input to the speech loss concealment circuit 120 for indicating whether the received signal Y(t) contains speech data or not. As will be explained below, the speech loss concealment circuit 120 functions differently depending on whether the received signal Y(t) contains speech data.

The speech loss concealment circuit 120 outputs speech-parameter error probability data W(t) to an a posteriori probability circuit 130. Like the related art softbit speech decoder 50, the softbit speech decoder 150 of the present invention also contains an a posteriori probability circuit 130 that receives stored prior knowledge from an a priori knowledge circuit 132 and provides probability information about any possibly transmitted bit combination. All of this data are output from the a posteriori probability circuit 130 to a parameter estimation circuit 134, which generates estimated speech parameters V(t) accordingly. The estimated speech parameters V(t) are output from the parameter estimation circuit 134 to a speech decoder 136, which decodes the estimated speech parameters V(t) into speech signals.

Figure 3:
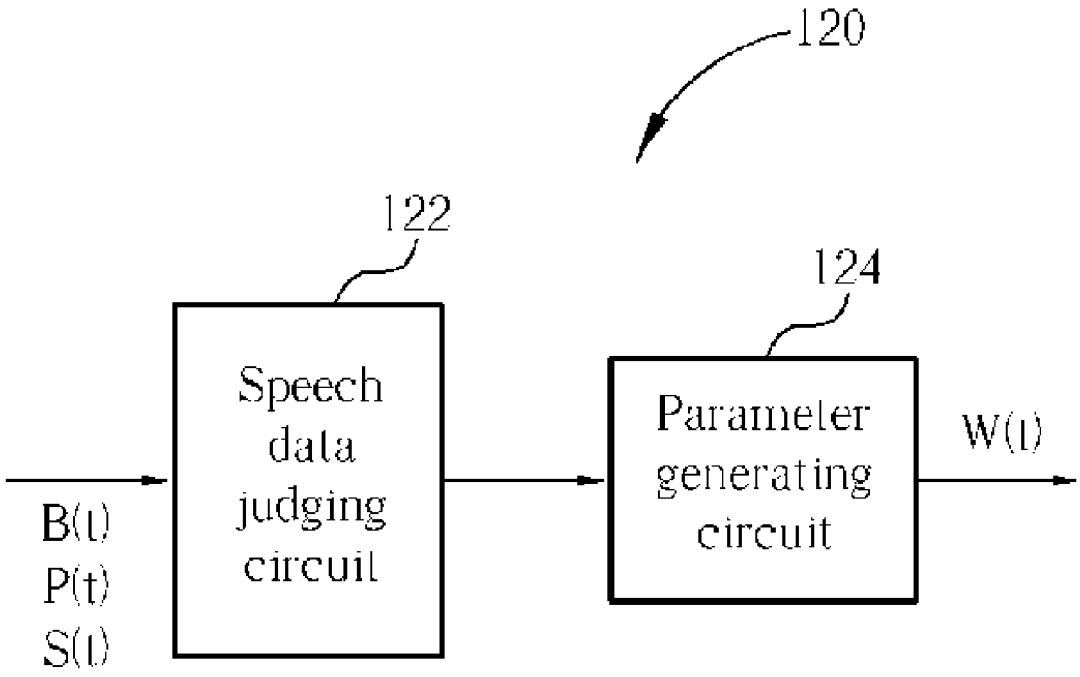
FIG. 3 is a detailed diagram of the speech loss concealment circuit of the present invention.

What distinguishes the present invention softbit speech decoder 150 from the related art is the operation of the speech loss concealment circuit 120. Please refer to FIG. 3. FIG. 3 is a detailed diagram of the speech loss concealment circuit 120 of the present invention. The speech loss concealment circuit 120 contains a speech data judging circuit 122 and a parameter generating circuit 124. The bit information B(t), the bit error probability data P(t), and the speech information flag S(t) are all input to the speech data judging circuit 122. The speech data judging circuit 122 then analyzes the speech information flag S(t) to determine whether the received signal Y(t) contains speech data or not.

If the received signal Y(t) contains speech data (S(t)=1), the speech data judging circuit 122 instructs the parameter generating circuit 124 to generate speech parameters X(t) and speech-parameter error probability data W(t) according to normal operation of the softbit speech decoder 150. That is, the speech parameters X(t) and the speech-parameter error probability data W(t) are generated according to equations (1) and (2) below:

$$X(t)=[x_1(t), \ldots, x_n(t)], \text{ with } [k_1, \ldots, k_n] \text{ bits} \quad (1)$$

$$W(t)=[w_1(t), \ldots, w_n(t)], \text{ where } w_i(t)=[w_i^1, \ldots, w_i^{2^i}] \quad (2)$$

Each of the speech parameters X(t) and the speech-parameter error probability data W(t) are vectors, and contain a plurality of elements for each given time t. However, the present invention is not limited to the above equations (1) or (2). Other equations can also be used for generating the speech parameters X(t) and the speech-parameter error probability data W(t).

If the received signal Y(t) does not contain speech data (S(t)=0), the speech data judging circuit 122 instructs the parameter generating circuit 124 to generate output information, including any values for the speech parameters X(t) and the speech-parameter error probability data vector W(t) as shown in equation (3) below:

$$W(t)=[\overline{\omega}_i(t), \ldots, \overline{\omega}_n(t)] \quad (3)$$

Thus, even when the received signal Y(t) does not contain speech data (S(t)=0), the speech loss concealment circuit 120 still generates speech-parameter error probability data W(t) and sends this data to the a posteriori probability circuit 130 and the parameter estimation circuit 134. Therefore, the softbit speech decoder 150 keeps operating even when the received signal Y(t) contains control signals instead of speech data (S(t)=0).

When there are no speech data presented in the received signal Y(t) (S(t)=0), the parameter generating circuit 124 of the present invention will generate the speech-parameter error probability data W(t) according to predetermined criteria, of which three different calculation methods are given below, although other algorithms can also be used as well.

For the following calculation methods, it is assumed that S(t+j)=1, for j=−1, −2, . . . , M and that S(t+j)=0, for j=0, 1, . . . , N. That is, speech data was received in the immediate past, but is no longer being received. Also, it is assumed that ($\alpha_i$ represents a constant vector with the same dimension as $\overline{\omega}_i(t)$, and that each element in the vector is equal.

The first calculation method uses the previous value of the speech-parameter error probability data W(t) to calculate the current value of the speech-parameter error probability data W(t), as shown in equation (4) below:

$$\overline{\omega}_i(t+j)=g*\overline{\omega}_i(t+j-1)+(1-g)*\alpha_i \text{ for } j=0, 1, 2, \ldots, L \quad (4)$$

where g is a constant between 0 and 1.

The second calculation method uses the previous M values of the speech-parameter error probability data W(t) to calculate the current value of the speech-parameter error probability data W(t), as shown in equation (5) below:

$$\overline{\omega}_i(t+j)=\Sigma_{m-1}^{M} g_m \overline{\omega}_i(t+j-m) \text{ for } j=0, 1, 2, \ldots, L \quad (5)$$

where $g_m$ is a predicted value taken from an offline speech database.

The third calculation method uses a constant value for each element in the speech-parameter error probability data vector W(t), as shown in equation (6) below:

$$\overline{\omega}_i(t+j)=\alpha_i, \text{ for } j=0, 1, 2, \ldots, L \quad (6)$$

Figure 4:
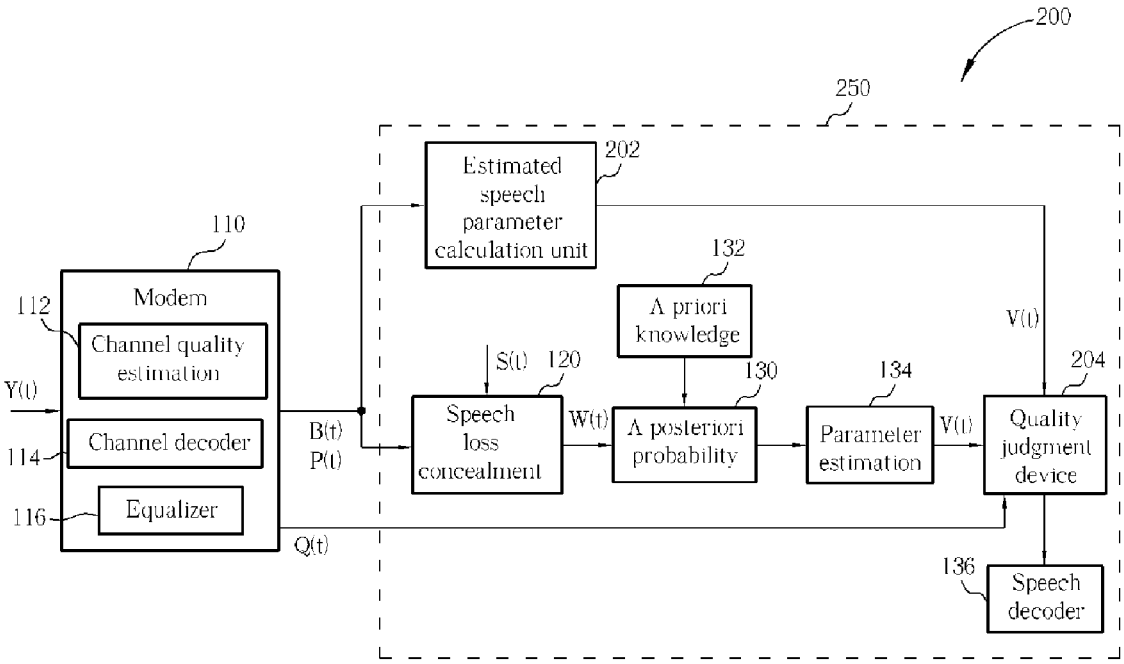
FIG. 4 is a block diagram of a speech decoding system utilizing a softbit speech decoder according to a second embodiment of the present invention.

Please refer to FIG. 4. FIG. 4 is a block diagram of a speech decoding system 200 utilizing a softbit speech decoder 250 according to a second embodiment of the present invention. Compared to the softbit speech decoder 150 shown in FIG. 2, the softbit speech decoder 250 contains an estimated parameter calculation unit 202 and a quality judgment device 204. In the second embodiment softbit speech decoder 250, the bit information B(t) and the bit error probability data P(t) are sent to both the speech loss concealment circuit 120 and the estimated speech parameter calculation unit 202. The estimated speech parameter calculation unit 202 assigns the bit information B(t) to be the estimated speech parameters V(t) and outputs the estimated speech parameters V(t) to the quality judgment device 204. Meanwhile, the estimated speech parameters V(t) output from the parameter estimation circuit 134 are also output to the quality judgment device 204.

In order for the quality judgment device 204 to select between the estimated speech parameters V(t) output from the estimated speech parameter calculation unit 202 and from the parameter estimation circuit 134, a channel quality indicator data Q(t) is analyzed. The channel quality indicator data Q(t), which indicates whether the channel quality meets minimum system requirements for quality, is provided to the quality judgment device 204 by the modem 110. If the channel quality reaches the minimum system requirements, the data transmitted in the channel are believed to be good enough to skip the error concealment operation. Therefore, when the channel quality meets the minimum system requirements, the quality judgment device 204 outputs the estimated speech parameters V(t) received from the estimated speech parameter calculation unit 202 to the speech decoder 136 because speech loss concealment does not need to be performed. On the other hand, if the channel quality does not reach the minimum system requirements, the data transmitted should not be perfect and further error concealment operation would be necessary. Therefore, when the channel quality does not meet the minimum requirements, the quality judgment device 204 outputs the estimated speech parameters V(t) received from the parameter estimation circuit 134 to the speech decoder 136 because speech loss concealment needs to be performed.

In this embodiment, it is assumed that the channel quality meets minimum system requirements if the bit error rate is less than or equal to a predetermined threshold level. However, other criteria can also be used to determine if the channel quality meets the minimum requirements.

Figure 5:
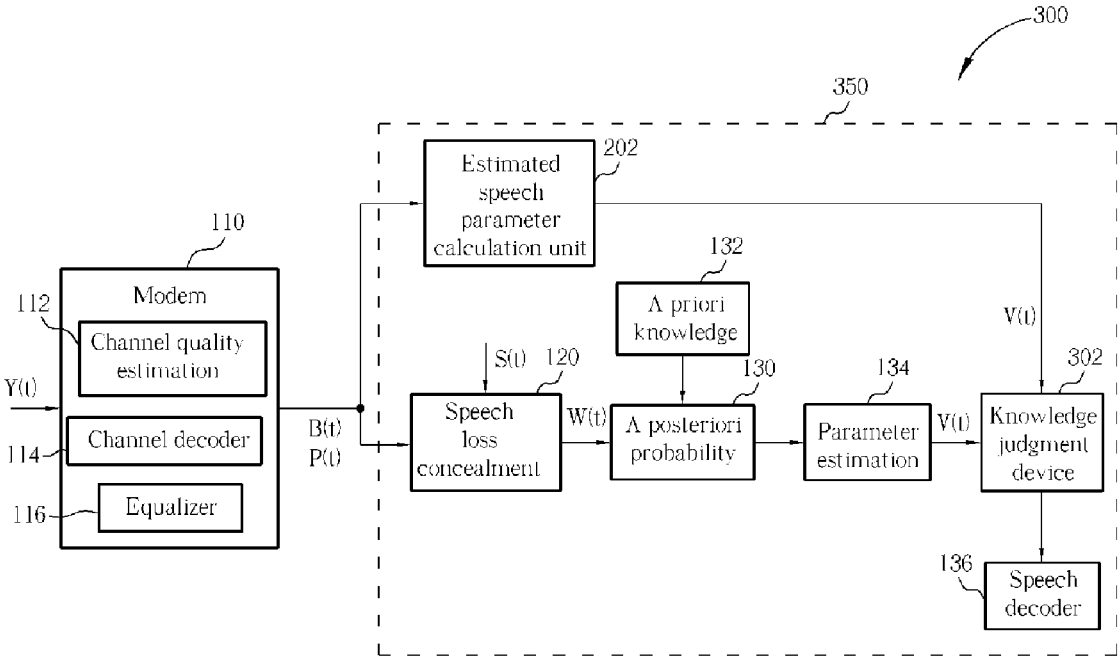
FIG. 5 is a block diagram of a speech decoding system utilizing a softbit speech decoder according to a third embodiment of the present invention.

Please refer to FIG. 5. FIG. 5 is a block diagram of a speech decoding system 300 utilizing a softbit speech decoder 350 according to a third embodiment of the present invention. Compared to the softbit speech decoder 150 shown in FIG. 2, the softbit speech decoder 350 contains the estimated parameter calculation unit 202 and a knowledge judgment device 302. Like the second embodiment, in the third embodiment softbit speech decoder 350, the bit information B(t) and the bit error probability data P(t) are sent to both the speech loss concealment circuit 120 and the estimated speech parameter calculation unit 202. The estimated speech parameter calculation unit 202 assigns the bit information B(t) to be the estimated speech parameters V(t) and outputs the estimated speech parameters V(t) to the knowledge judgment device 302. The estimated speech parameters V(t) output from the parameter estimation circuit 134 are also output to the knowledge judgment device 302.

In order for the knowledge judgment device 302 to select between the estimated speech parameters V(t) output from the estimated speech parameter calculation unit 202 and from the parameter estimation circuit 134, the knowledge judgment device 302 analyzes whether the speech data contained in the received signal Y(t) conforms to the prior knowledge stored in the a priori knowledge circuit 132. If the speech data does not conform to the prior knowledge, the prior knowledge stored in the a priori knowledge circuit is considered an improper reference data for the error concealment operation. Therefore, the knowledge judgment device 302 outputs the estimated speech parameters V(t) received from the estimated speech parameter calculation unit 202 to the speech decoder 136 because speech loss concealment should not be performed in this case. On the other hand, if the speech data conforms to the prior knowledge, the prior knowledge stored in the a priori knowledge circuit is considered a good reference data for the error concealment operation. Thus, the knowledge judgment device 302 outputs the estimated speech parameters V(t) received from the parameter estimation circuit 134 to the speech decoder 136 because speech loss concealment should be performed in this case.

In contrast to the related art, the parameter generating circuit of the present invention speech loss concealment circuit generates the speech-parameter error probability data W(t) when the speech information flag S(t) indicates that the received signal Y(t) does not contain speech data. Therefore, the softbit speech decoder continues operating when control signals are received and when no speech data is received. Therefore, the softbit speech decoder will reduce the subjective effects of bit errors that have not been eliminated by channel decoding, even when no speech data are currently transmitted.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A softbit speech decoder, comprising:

a speech loss concealment circuit, receiving bit information, bit error probability data, and a speech information flag from an equivalent channel based on a received signal provided to the equivalent channel, comprising:

a speech data judging circuit for judging whether the speech information flag indicates that the received signal contains speech data; and a parameter generating circuit for generating output information, the output information including a first speech-parameter error probability vector when the speech information flag indicates that the received signal contains speech data, and a second speech-parameter error probability vector when the speech information flag indicates that the received signal does not contain speech data;

a probability generating device for generating probability information based on the output information;

a parameter estimation circuit for calculating estimated speech parameters based on the probability information; and a speech decoding circuit for decoding speech signals based on the estimated speech parameters.

2. The softbit speech decoder of claim 1, wherein the probability generating device further comprises:

an a priori knowledge circuit for providing prior knowledge; and an a posteriori probability circuit for providing the probability information based on the prior knowledge and the output information.

3. The softbit speech decoder of claim 2, further comprising:

an estimated speech parameter calculation circuit for calculating the estimated speech parameters based on the bit information received from the equivalent channel; and a knowledge judgment device for judging whether the speech data contained in the received signal conforms to the prior knowledge stored in the a priori knowledge circuit, for transmitting the estimated speech parameters output from the parameter estimation circuit to the speech decoding circuit if the speech data contained in the received signal conforms to the prior knowledge, and for transmitting the estimated speech parameters output from the estimated speech parameter calculation circuit to the speech decoding circuit if the speech data contained in the received signal does not conform to the prior knowledge.

4. The softbit speech decoder of claim 1, further comprising:

an estimated speech parameter calculation circuit for calculating the estimated speech parameters based on the bit information received from the equivalent channel; and a quality judgment device for judging whether a channel quality of the equivalent channel meets minimum requirements, wherein the quality judgment device transmits the estimated speech parameters output from the parameter estimation circuit to the speech decoding circuit if the channel quality meets the minimum requirements, and transmits the estimated speech parameters output from the estimated speech parameter calculation circuit to the speech decoding circuit if the channel quality does not meet the minimum requirements.

5. The softbit speech decoder of claim 4, wherein the channel quality meets the minimum requirements if a bit error rate of the equivalent channel is less than or equal to a predetermined threshold level.

6. The softbit speech decoder of claim 1, wherein the parameter generating circuit calculates the second speech-parameter error probability vector based on a previous speech-parameter error probability vector generated by the parameter generating circuit.

7. The softbit speech decoder of claim 1, wherein the parameter generating circuit calculates the second speech-parameter error probability vector based on a plurality of previous speech-parameter error probability vectors generated by the parameter generating circuit.

8. The softbit speech decoder of claim 1, wherein the parameter generating circuit sets each element in the second speech-parameter error probability vector to be constant and equal.

9. The method of claim 8, wherein the second speech-parameter error probability vector is calculated based on a previous speech-parameter error probability vector.

10. The method of claim 8, wherein the second speech-parameter error probability vector is calculated based on a plurality of previous speech-parameter error probability vectors.

11. The method of claim 8, wherein each element in the second speech-parameter error probability vector is set to be constant and equal.

12. A method of softbit speech decoding, comprising:

(a) receiving bit information, bit error probability data, and a speech information flag from an equivalent channel based on a received signal provided to the equivalent channel;

(b) judging whether the speech information flag indicates that the received signal contains speech data;

(c) generating output information, the output information including a first speech-parameter error probability vector when the speech information flag indicates that the received signal contains speech data and a second speech-parameter error probability vector when the speech information flag indicates that the received signal does not contain speech data;

(d) generating probability information based on the output information;

(e) calculating estimated speech parameters based on the probability information; and (f) decoding speech signals based on the estimated speech parameters.

13. The method of claim 12, further comprising:

providing prior knowledge; and generating the probability information based on the prior knowledge and the output information.

14. The method of claim 13, further comprising:

calculating estimated speech parameters based on the bit information received from the equivalent channel;

judging whether the speech data contained in the received signal conforms to the prior knowledge;

decoding the estimated speech parameters generated in step (d) if the speech data contained in the received signal conforms to the prior knowledge; and decoding the estimated speech parameters calculated based on the bit information received from the equivalent channel if the speech data contained in the received signal does not conform to the prior knowledge.

15. The method of claim 12, further comprising:

calculating estimated speech parameters based on the bit information received from the equivalent channel;

judging whether a channel quality of the equivalent channel meets minimum requirements;

decoding the estimated speech parameters generated in step (d) if the channel quality meets the minimum requirements; and decoding the estimated speech parameters calculated based on the bit information received from the equivalent channel if the channel quality does not meet the minimum requirements.

16. The method of claim 15, wherein the channel quality meets the minimum requirements if a bit error rate of the equivalent channel is less than or equal to a predetermined threshold level.

* * * * *